United States Patent [19]

Daly et al.

[11] Patent Number: 4,766,405

[45] Date of Patent: Aug. 23, 1988

[54] DYNAMIC ENERGY ABSORBER

[75] Inventors: Paul D. Daly, Troy; Mark A. Brooks, Sterling Heights; Robert Fallis, Milford, all of Mich.

[73] Assignee: Allied Corporation, Morris Township, Morris County, N.J.

[21] Appl. No.: 38,162

[22] Filed: Apr. 14, 1987

[51] Int. Cl.[4] ..... H01F 7/08

[52] U.S. Cl. ..... 335/257; 335/258; 335/277

[58] Field of Search ..... 335/255, 257, 258, 271, 335/273, 277, 279

[56] References Cited

U.S. PATENT DOCUMENTS 4,114,125 9/1978 Komatsu ..... 335/258

*Primary Examiner*—George Harris

*Attorney, Agent, or Firm*—Markell Seitzman; Russel C. Wells

[57] ABSTRACT

A device (10;50) comprising an armature (12;80) movable in a first and a second direction;

an obstruction for (20;22;60;74) for providing a motion stop in at least the first direction;

an electromagnetic and return spring (18;28;60;140) for moving said armature in the first and second directions; and a damper attached to and movable with said armature for dissipating energy from the collision of the armature with the motion stop.

21 Claims, 2 Drawing Sheets

FIG. 1
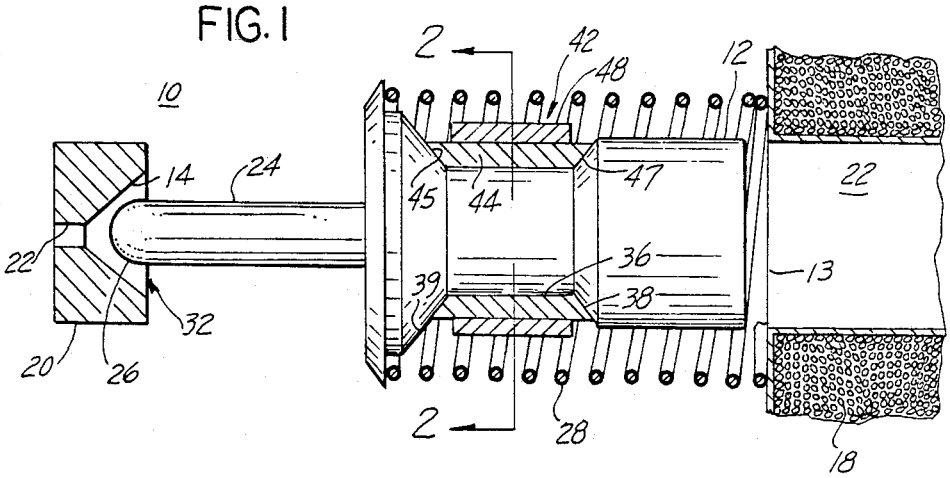
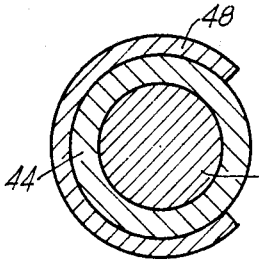
FIG. 2
FIG. 3
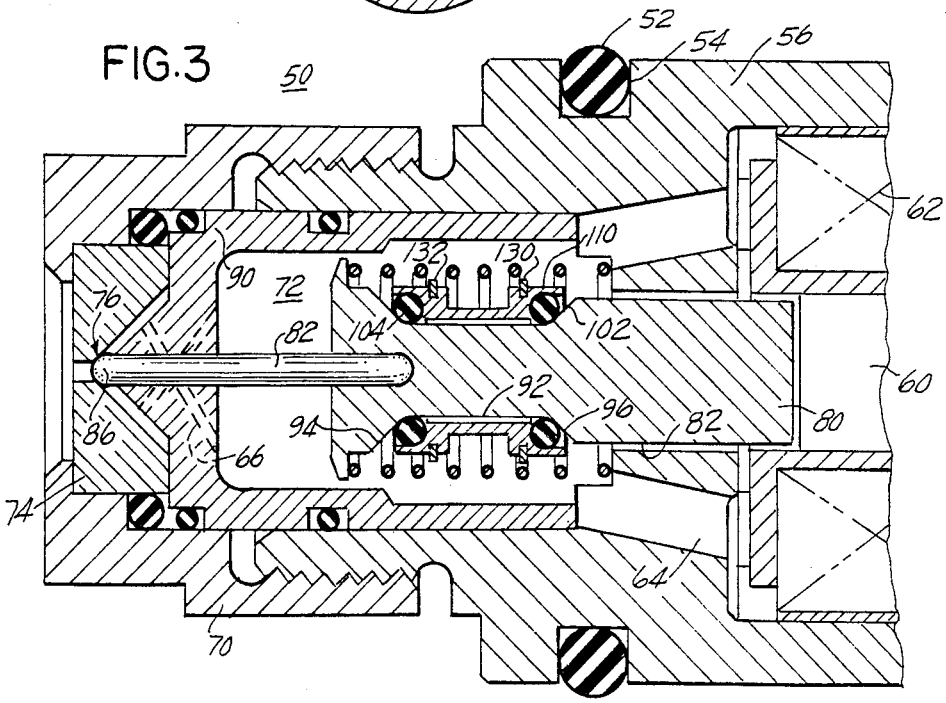

FIG. 4
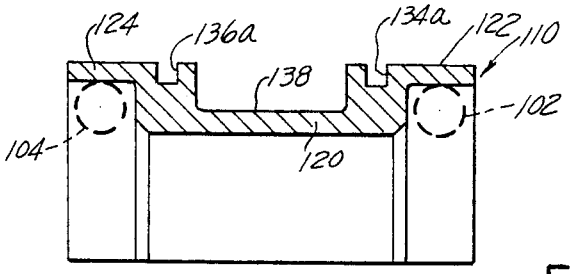
FIG. 6
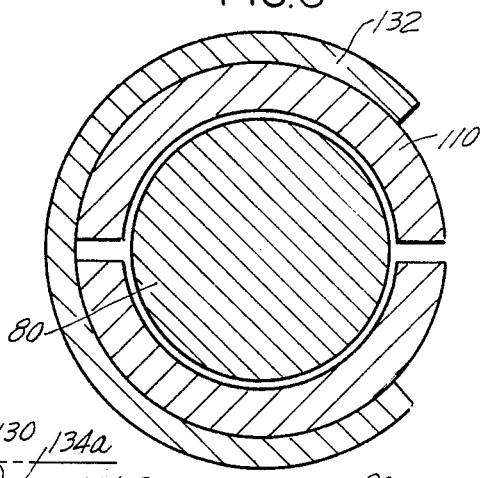
FIG. 5
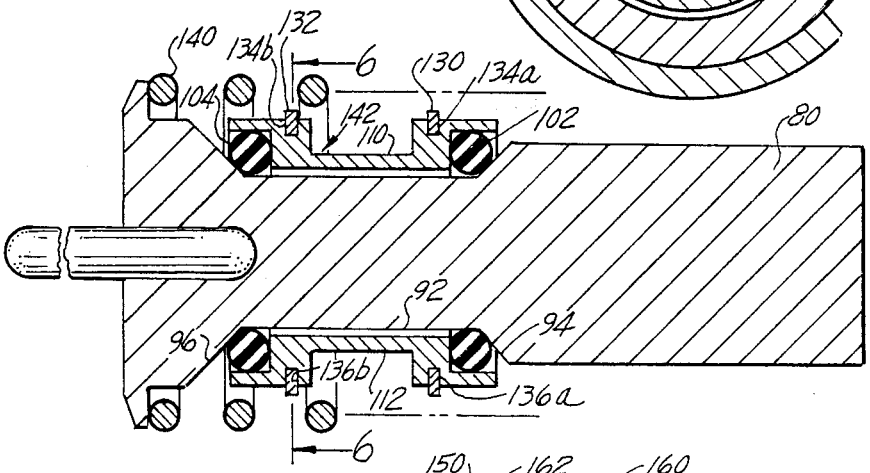
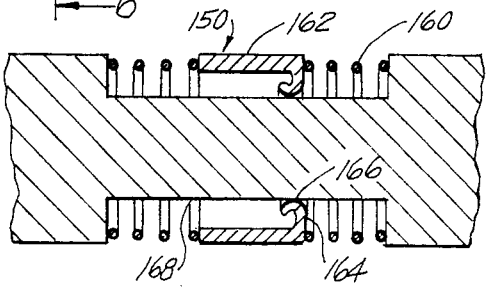
FIG. 7

DYNAMIC ENERGY ABSORBER

BACKGROUND AND SUMMARY OF THE INVENTION

The present invention relates in general to means for controlling the bounce or rebound motion of an armature of a solenoid valve and finds use in high performance fuel injectors.

In general, a solenoid valve comprises an armature movable between a first and second position. The extremes of the these first and second positions are often defined by mechanical stops. Armatures, as is known in the art, are moved in one direction by a electro-magnetic force generated by a coil of wire and often moved in the opposite direction by a return spring. When the armature impacts a stop it bounces. Bounce or rebound is detrimental especially if the solenoid is to be used as a positioning device because desired position cannot be maintained, or if the solenoid is incorporated within a fuel injector wherein when the armature moves toward or away from a valve seat due to bounce or rebound more or less fuel, as the case may be, will be ejected from the fuel injector. The bouncing continues until the hystersis losses in the armature and/or stop finally cause the armature to come to rest. As can be seen, the bounce of an armature effects the operation of a fuel injector by: prolonging or shorting the duration of injection, causing non-linearality in calibration, excessive wear about the valve seat area, poor and variable atomization of the ejected fuel, a lack of repeatability in the operation of the injector over its useful life and a cycle-to-cycle variation in the performance of the injector.

In view of the above it is primary object of the present invention to provide means for damping the motion of an armature to lesson and/or totally eliminate bounce. A further object of the invention is to eliminate bounce through the use of an energy absorbing device.

Accordingly the present invention comprises: means, attached to and movable with the armature for damping the motion of an armature by dissipating energy from a collision of the armature with the stop means. In one embodiment of the invention the damping means comprises a dynamic energy absorber or damper including an elastomeric sheath positioned about the armature and a weight attached to the outer surface of the sheath. In another embodiment of the invention the absorber comprises a plurality elastomeric rings positioned about and axially spaced along the armature and a weight, compressively loaded onto the O-rings. In this embodiment of the invention the weight comprises two semi-cylindrical sections, opposingly positioned onto the O-rings and wherein the spring loading is derived from a plurality of spring rings received about the semi-cylindrical sections. In another embodiment the absorber comprises a spring loaded weight which rubs upon the exterior of an armature to dissipate energy.

Many other objects and purposes of the invention will be clear from the following detailed description of the drawings.

BRIEF DESCRIPTION OF THE DRAWINGS

In the drawings:

FIG. 1 diagrammatically illustrates a fuel injector incorporating the present invention.

FIG. 2 is a cross-sectional view taken through 2—2 of FIG. 1.

FIG. 3 illustrates an alternate embodiment of the invention.

FIG. 4 illustrates an isolated, partial cross-sectional view of one of the members comprising the harmonic damper shown in FIG. 3.

FIG. 5 is an enlarged view of the armature in FIG. 3.

FIG. 6 is a cross-sectional view taken through section 6—6 of FIG. 5.

FIG. 7 illustrates another embodiment of the invention.

DETAILED DESCRIPTION OF THE DRAWINGS

FIG. 1 diagrammatically illustrates a typical electromechanical solenoid device 10 having an armature 12 movable between a first stop 13 and a second stop 14 in response to a magnetic force generated by a coil 18 and return spring 28. The armature 12 may typically be formed of a soft iron-like material. The above-mentioned parts, of course, are situated within a appropriate housing which is not shown in FIG. 1. It should be appreciated that if the solenoid device 10 is a fuel injector the stop 14 may be fabricated within a valve seat 20 having a metering orifice 22 situated therein. The coil 18 may be wound about a stator 22, the lower end of which forms the stop 13. A pin 24 may extend from or may be fabricated as an integral extension of the armature 12. The pin 24 includes an arcuately shaped closure end 26 which is adapted to seat upon and seal the stop or seating surface 14 formed within the valve seat. As illustrated in FIG. 1 the valve seating surface 14 is conically shaped and the end of the closure element 26 is preferably spherically shaped. The particular design of the closure element and valve seat and or location of the stops 13, 14 are not particularly pertinent to the present invention and may be replaced by any of the structures employed in solenoid valves. The fuel injector illustrated in FIG. 1 is of the normally closed variety having a bias spring 28 which urges the armature 12 toward the valve seat 20. As previously mentioned, the armature is moved to an open position, away from the valve seat 20, in response to the energization of the coil 18. Upon energization of the coil 18 pressurized fluid within the fuel injector 10 is permitted to exit the fuel injector through the metering orifice. The arrow, designated as 32, is illustrative of the direction of fluid flow.

As shown in FIG. 1 the armature 12 includes a necked down portion 36 defined by two annular, tapered shoulders 38 and 39. Positioned between the shoulders 38 and 39 is a dynamic energy absorber or damper 42 comprising a ring 44 of elastomeric material such as rubber or the like. The ends 45 and 47 of the material 44 are tapered and are tightly received on the shoulders 38 and 39 so that the ring 44 of material cannot slide axially. Positioned about and fastened to the elastomeric ring 44 is a weight 48. As illustrated in FIGS. 1 and 2 the weight 48 is preferably fabricated of non-magnetic material such as brass and, may take the form of a split cylinder or ring which can be opened to fit about the elastomeric ring 44. The weight 48, which can also be fabricated of magnetic material, may be fastened, such as by epoxy, to the outer surface of the elastomeric ring 44. By selecting the spring rate of the elastomeric material and the mass of the weight 48, the bounce of the armature 12 as it impacts a mechanical stop is significantly reduced and/or eliminated as the some of the energy of the collision is dissipated by the elastomeric material.

Reference is now made to FIG. 3 which illustrates a more detailed embodiment of a fuel injector and further illustrates an alternate embodiment of the present invention. The fuel injector 50 is designed to be inserted within an opening within the cylinder walls of an engine such that an O-ring 52 situated within a annular groove 54 of a housing 56, is compressed. The housing 56 which is partially shown supports a stator 60 about which is position in a electrical coil 62. The housing includes a plurality of passages such as 64, 66 for permitting fuel to flow therethrough. Attached to the lower end of the housing is an end cap 70. The housing 56 and end cap cooperated to define a fuel chamber 72. Situated within the lower end of the chamber is a valve seat 74 having a metering orifice 76 therein. The valve seat 74 includes a seating surface 76. Also, positioned within the cavity 72 is an armature 80 slidably received within the bore 82 of a housing. FIG. 5 is an enlarged view of the armature 80. Extending from the armature 80 is a pin 84 having a closure surface 86 thereon for seating upon the valve seat 74. The pin 84 is guided by a valve guide and retainer member 90 which includes the passages 66. The armature 80 includes a neck-down portion 92 similar to that shown in FIG. 1, defined by two inclined annular shoulders 94 and 96. O-rings 102 and 104 are positioned about respective shoulders 94 and 96. Such O-rings 102 and 104 are fabricated of elastomeric material such as rubber and are functionally equivalent to the ring or sheath 44 of elastomeric material shown in FIG. 1. Secured about the O-rings 102 and 104 is a weight. In this embodiment the weight comprises the two, identical semi-cylindrical members 110 and 112 oppositely positioned relative to one another and positioned about the armature 80. In the above embodiment, the members are positioned about the necked-down portion. An enlarged, isolated cross-sectional view of one of the weights such as 110 is illustrated in FIG. 4. As shown in FIG. 4 each member comprises an inner axially directed wall 120 having axially extending flanges 122 and 124. The flanges 122 and 124 are formed at a radius greater than that of a radius of the wall 120 such that when the members are positioned about the necked-down portion 92 of the armature 80, the members 110 and 120 will compress a portion of the O-rings 102 and 104 against the tapered shoulders 94 and 96 respectively. The members 110 and 112 are secured to the armature 80 by circular spring or snap rings 130 and 132 which are received within corresponding grooves 134*a* and b and 136*a* and b fabricated within the members 110 and 112. In this manner, the spring rings circumferentially bind the members 110 and 112 around the armature 80. As can be seen once the members 110 and 112 are secured by the rings 130 and 132 they can move in an axially direction by compressing the respective O-rings 102 and 104.

While the shoulders 94 and 96 are shown as inclined or tapered this is not a requirement of the invention. The tapered shoulders can be replaced with blunt or arcuately shaped shoulders as well as grooves all of which cooperate with the members 110 and 112 to secure the O-rings relative to the armature 80. The following is illustrative of the physical make-up of the armature 80, members 110 and 112, snap rings 130 and 132 and O-rings 102 and 104. In a prototype injector the weight of the combination of the armature, members, snap rings and O-rings was approximately 1.12 grams. The weight of the members, snap rings and O-rings, expressed as a percentage of the combined weight, are 11.5%, 0.84% and 0.73% respectively. The O-rings used are model number .098*.026*70BN made by Apple.

In operation as the armature is outwardly biasedby its return spring 140 into the valve seat 72 a portion of the impact force is absorbed by the damper 142 comprising the O-rings 102, members 110, 112 and the rings 130 and 132. More specifically, the energy is dissipated as the weights compress and transfer energy to the respective O-rings.

Reference is briefly made to FIGS. 3 and 4, each of the members 110 and 112 includes a cut out portion 138 the purpose of which is to illustrate the fact that the members 110 and 112 may be easily tuned by removing mass to obtain the correct damping factor for the armature. Further, it should be noted that in the embodiment of invention illustrated in FIG. 3 the inner wall 120 of each of the weights is spaced, by the O-rings 102 and 104, from the armature 80. Such spacing is not a requirement of the invention. As can be seen from the above, if the members 110 and 112 are permitted to loosely contact the armature 80 the axial motion of the members 110 and 112 on the surface of the armature 80 will, in fact, contribute to the effective damping established by the damper 142.

In the first and second embodiments of the invention, illustrated in FIGS. 1 and 3, the absorbers or dampers were constructed of elastomeric materials such as the elastomeric ring 44 and O-rings 102 and 104. The embodiment of the invention illustrated in FIG. 7 shows another damper 150 comprising a metal spring 160 positioned about and engaged at its ends to the armature 80. Attached to and axially movable with the spring 160 as it compresses and extends, is a damping mechanism 162. Such damping mechanism 162 comprises an annular ring having a inwardly extending annular shoulder 164. Fabricated in the shoulder is an arcuately shaped rubbing surface 166 which is maintained in contact with a surface, such as surface 168 of the armature 80. As the armature 80 impacts a stop such as a valve seat the energy of the impact will be transmitted to the damper 150 and dissipated as the rubbing surface 166 slides overthe surface 168. The material of the damper 150, is not important so long as the correct mass and dimensional stability can be obtained. Typical materials can be stainless steel or plastic.

Many changes and modifications in the above described embodiments of the invention can, of course, be carried out without departing from the scope thereof. One such modification is to incorporate the above energy absorbing mechanisms into devices that are activated by means other than electromagnetics such as an hydraulically activated fuel injector. Accordingly, that scope is intended to be limited only by the scope of the appended claims.

We claim:

1. A device comprising an armature movable in a first and a second direction;

means for providing a motion stop in at least said first direction;

means for moving said armature in said first and said second directions; and means, attached to and movable with said armature for damping the motion of said armature by dissipating energy from a collision of said armature with said stop means wherein said damping means comprises a damper including an elastomeric sheath positioned about said armature and a weight attached to the outer surface of said sheath.

2. The device as defined in claim 1 wherein said moving means includes an electric coil and wherein said weight is nonmagnetic.

3. The device as defined in claim 2 wherein said armature comprises a necked-down portion and includes opposingly positioned, axially spaced, shoulders;

said elastomeric sheath received onto said necked down position and including ends engagably mating said shoulders; and said weight comprising a cylindrical member positioned about said sheath.

4. The device as defined in claim 3 wherein said weight comprises a cylindrical ring including a split wall.

5. The device as defined in claim 3 wherein said weight is affixed to said elastomeric sheath.

6. The device as defined in claim 1 wherein said damping means comprises a plurality elastomeric rings positioned about and axially spaced along said armature; and a weight, compressively loaded onto said rings.

7. The device as defined in claim 6 wherein said weight comprises two semi-cylindrical sections, opposingly positioned onto said rings and wherein compressive loading is derived from a plurality of spring rings received about said sections.

8. The device as defined in claim 7 wherein said sections substantially envelop approximately one half of the circumference of said armature.

9. The device as defined in claim 8 wherein said armature includes a necked down portion including two spaced, shoulders, and wherein said elastomeric rings are compressively loaded by said sections against a respective one of said shoulders.

10. The device as defined in claim 9 wherein such sections, proximate said elastomeric ring, include means for receiving and securing one of said elastomeric rings.

11. A device comprising an armature movable in a first and a second direction;

means for providing a motion stop in at least said first direction;

means for moving said armature in said first and said second directions; and means, attached to and movable with said armature for damping the motion of said armature by dissipating energy from a collision of said armature with said stop means wherein said damping means comprises a spring supported member including a first surface slidably engaging a surface of the armature wherein energy is dissipated as said first surface co-acts with the surface of the armature.

12. A device comprising an armature adapted to be moved in a first and a second direction relative to a motion stop; and means, attached to and movable with said armature, for damping the motion of said armature by dissipating energy of a collision of said armature with said motion stop wherein said damping means comprises an elastomeric sheath positioned about said armature and a weight attached to the outer surface of said sheath.

13. The device as defined in claim 12 wherein said armature comprises a necked-down portion and includes opposingly positioned, axially-spaced, shoulders;

said elastomeric sheath received onto said necked-down portion and including ends engagably mating said shoulders; and said weight comprising a cylindrical member positioned about said sheath.

14. The device as defined in claim 13 wherein said weight comprises a cylindrical ring including a split wall.

15. The device as definedin claim 13 wherein said weight is affixed to said elastomeric sheath.

16. The device as defined in claim 12 wherein said damping means comprises a plurality elastomeric rings positioned about and axially spaced along said armature; and a weight, compressively loaded onto said rings.

17. The device as defined in claim 7 wherein said weight comprises two semi-cylindrical sections, opposingly positioned onto said rings and wherein compressive loading is derived from a plurality of spring rings received about said sections.

18. The device as defined in claim 17 wherein said sections substantially envelop approximately one half of the circumference of said armature.

19. The device as defined in claim 18 wherein said armature includes a necked down portion including two spaced, shoulders, and wherein said elastomeric rings are compressively loaded by said sections against a respective one of said shoulders.

20. The device as defined in claim 19 wherein such sections, proximate said elastomeric ring, include means for receiving and securing one of said elastomeric rings.

21. The device as defined in claim 12 wherein said damping means comprises a spring supported member including a first surface slidably engaging a surface of the armature wherein energy is dissipated as said first surface coacts with the surface of the armature.

* * * * *